US007712589B2

(12) United States Patent
Pinto et al.

(10) Patent No.: US 7,712,589 B2
(45) Date of Patent: May 11, 2010

(54) DEVICE AND METHOD FOR BRAKING THE SUPPORTING BOOMS OF AN EARTHMOVING MACHINE

(75) Inventors: Massimo Pinto, Chieri (IT); Luca Fontana, Turin (IT)

(73) Assignee: CNH America LLC, New Holland, PA (US)

( * ) Notice: Subject to any disclaimer, the term of this patent is extended or adjusted under 35 U.S.C. 154(b) by 1226 days.

(21) Appl. No.: 11/264,253

(22) Filed: Nov. 1, 2005

(65) Prior Publication Data

US 2006/0090974 A1 May 4, 2006

(30) Foreign Application Priority Data

Nov. 4, 2004 (IT) ..... MI2004A2109

(51) Int. Cl.
*E02F 3/32* (2006.01)

(52) U.S. Cl. ..... 188/71.1; 414/694; 414/699

(58) Field of Classification Search ..... 303/2, 303/9, 61–9.71; 414/685–699; 180/273; 188/71.1

See application file for complete search history.

(56) References Cited

U.S. PATENT DOCUMENTS 3,791,492 A * 2/1974 Neilsen ..... 188/170
3,797,275 A * 3/1974 David et al. ..... 60/716
3,908,843 A * 9/1975 Noller et al. ..... 414/694
4,059,196 A * 11/1977 Uchino et al. ..... 414/699
4,147,442 A * 4/1979 Bridwell et al. ..... 403/4
4,365,926 A * 12/1982 Brown ..... 414/685
5,054,990 A 10/1991 Schaeff et al.
5,625,967 A 5/1997 Kulle et al.
6,010,018 A * 1/2000 Pech ..... 212/292
7,021,722 B2 * 4/2006 Ruppert et al. ..... 303/2

FOREIGN PATENT DOCUMENTS

| | | |
|---|---|---|
| DE | 2361967 | 6/1975 |
| DE | 3035250 | 4/1982 |
| DE | 3617673 | 12/1987 |
| JP | 08260523 | 10/1996 |
| SE | 464644 | 12/1987 |

* cited by examiner

*Primary Examiner*—Christopher P Schwartz
(74) *Attorney, Agent, or Firm*—Patrick M. Sheldrake; John William Stader; Michael G. Harms

(57) ABSTRACT

This invention relates to a device for reducing the reaction force of the supporting booms positioning cylinder of an earthmoving machine, comprising a braking system applied between the supporting booms of the machine which is operated during the time in which the positioning cylinder remains inactive, thereby unloading part of the reaction force of the cylinder, hence reducing the stress.

10 Claims, 5 Drawing Sheets

DEVICE AND METHOD FOR BRAKING THE SUPPORTING BOOMS OF AN EARTHMOVING MACHINE

FIELD OF THE INVENTION

The present invention relates to a device and method for braking the supporting booms of an earthmoving machine, for example an excavator, and a machine equipped with said device.

BACKGROUND OF THE INVENTION

Different types of earthmoving machines are known in the prior art, with different functions related to the type of performance and power required. For instance, there are single-boom or multi-boom excavators, depending on the number of knuckle booms which connect the bucket to the machine body. A multi-boom excavator generally allows more flexibility of use compared to the single-boom type. A multi-boom excavator is generally equipped with at least one specific knuckle between two consecutive booms having a supporting boom function, wherein the relative angle of inclination between the two booms is fixed during operation but can be adjusted—generally in a standstill position—by one or more positioning cylinders connected between the two booms operated by the operator. There is also an excavation boom to which the excavating bucket is attached; the angle of the bucket can usually be changed during the excavation operations.

A multi-boom excavator with more flexibility may give rise to reliability problems. In particular, the positioning cylinder operates as a large-sized sprag, since it must withstand a strong reaction force which can cause resistance problems in the cylinder supports, in the cylinder thereof, and in its lock valve, if any. The cylinder is strongly stressed because during particularly heavy-duty excavation operations—for example when working on hard ground—the pressure of the fluid inside of it may be very high, as it is proportional to the reaction force that the cylinder needs to exert to keep the two booms in a relative fixed position. In these conditions, the cylinder supports are subjected to high stress, so much so that it could even lead to their rupture.

SUMMARY OF THE INVENTION

Therefore, the purpose of the present invention is to solve the above-mentioned problems and to propose a device and method for braking the supporting booms of an earthmoving machine, for example an excavator, and a machine equipped with said device, capable of reducing the reaction force of the positioning cylinders. The reduction of the reaction force of the positioning cylinder is achieved, according to the present invention, via a braking system applied between two supporting booms which is operated during the time in which the positioning cylinder remains inactive—hence the angle between the two booms remains fixed—during the excavation operations, thereby unloading part of the reaction force of the cylinder, hence reducing the stress.

The system described above creates a stall torque relative to the pivot between the two booms, which transfers a part of the reaction onto the braking element thereof. The induced pressure of the fluid inside the positioning cylinder is advantageously used for operating the braking system. Therefore, the present invention relates to a device for braking the supporting booms of an earthmoving machine, said machine equipped with two or more supporting booms, interconnected by pivoting points, and one or more positioning cylinders capable of determining the relative angular position of said supporting booms, characterized in that it comprises one or more braking systems applied to said supporting booms, capable of exerting a braking action on said supporting booms during a time in which the said one or more positioning cylinders remain inactive.

The present invention relates particularly to a device and method for braking the supporting booms of an earthmoving machine, for example an excavator, and a machine equipped with said device, as described more fully in the claims, which are an integral part of this description.

The purposes and advantages of this invention will become clear from the following detailed description of a preferred embodiment, and the relative alternative forms of embodiment, and the drawings that are attached hereto, which are merely illustrative and not limitative.

DETAILED DESCRIPTION OF THE EXEMPLARY EMBODIMENTS

Figures 1, 2:
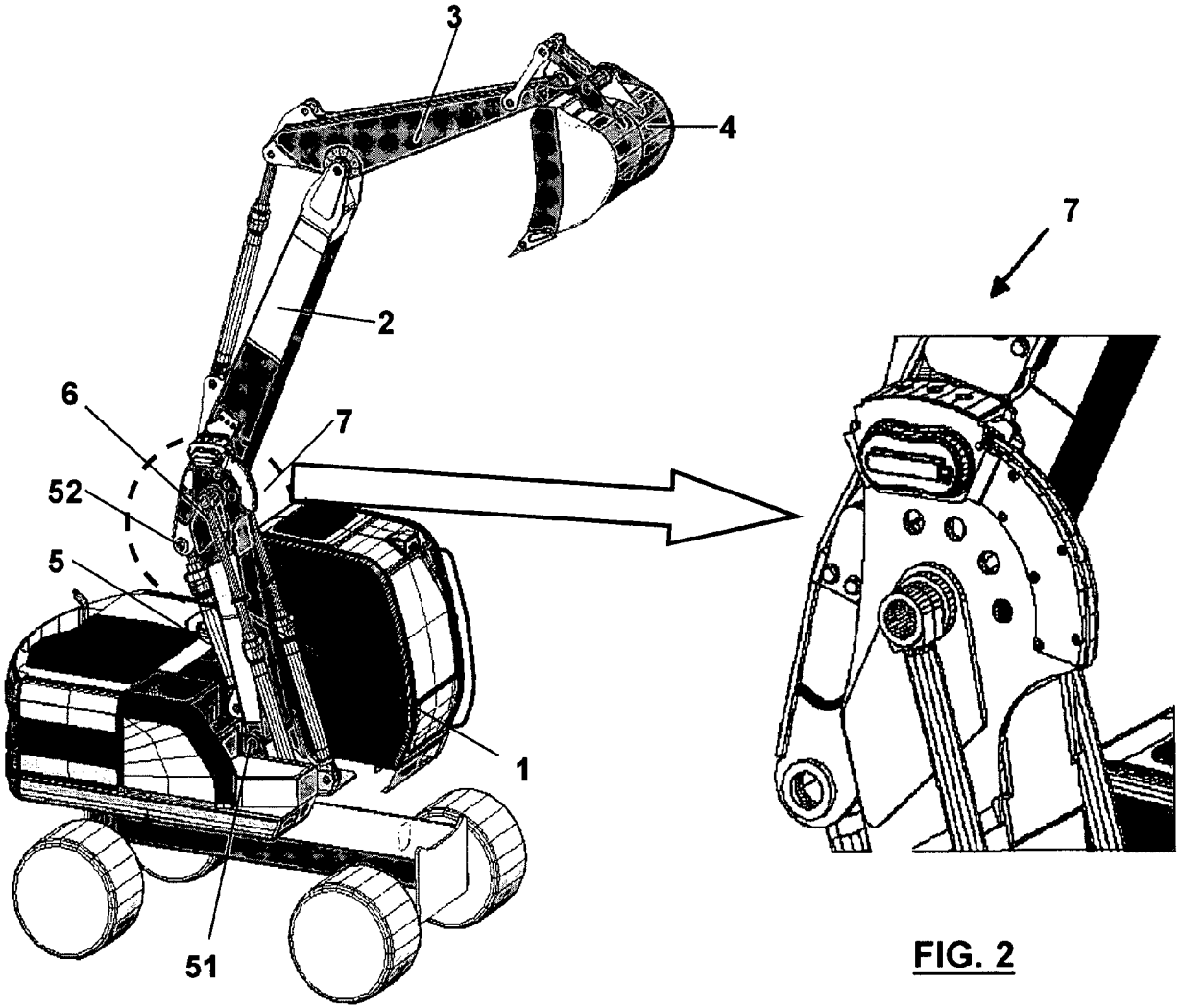
FIG. 1 describes an excavator equipped with three booms, wherein a braking device is applied in accordance with the present invention.
FIG. 2 shows an enlargement of the detail in which the braking system is applied to the excavator.

In the drawings the same reference numbers and letters are used to identify the same elements. FIG. 1 shows an example of a three-boom excavator, wherein a first boom 1 and a second boom 2 are the supporting booms, whereas a third one 3 serves as an excavating boom which is connected to a bucket 4.

There is a positioning cylinder 5 connected between the first boom 1 and the second boom 2, pivoted to the end 51 of the first boom connected to the excavator, and to the end 52 of the second boom opposite the connection of the third boom, respectively, near the pivot 6 between the two booms. The positioning cylinder 5 is operated by the operator in order to determine the angle between the two supporting booms 1 and 2. This angle generally remains fixed during the excavation operations. Hence, according to the present invention, a braking system 7 is achieved, for example, at the extension part of the first boom 1, as shown in the dotted circle in FIG. 1, enlarged in FIG. 2.

The braking system 7 produces a reactive torque relative to the pivot 6 between the two booms, which makes it possible to reduce the stress on the positioning cylinder to a typical value of 30%.

Figure 3:
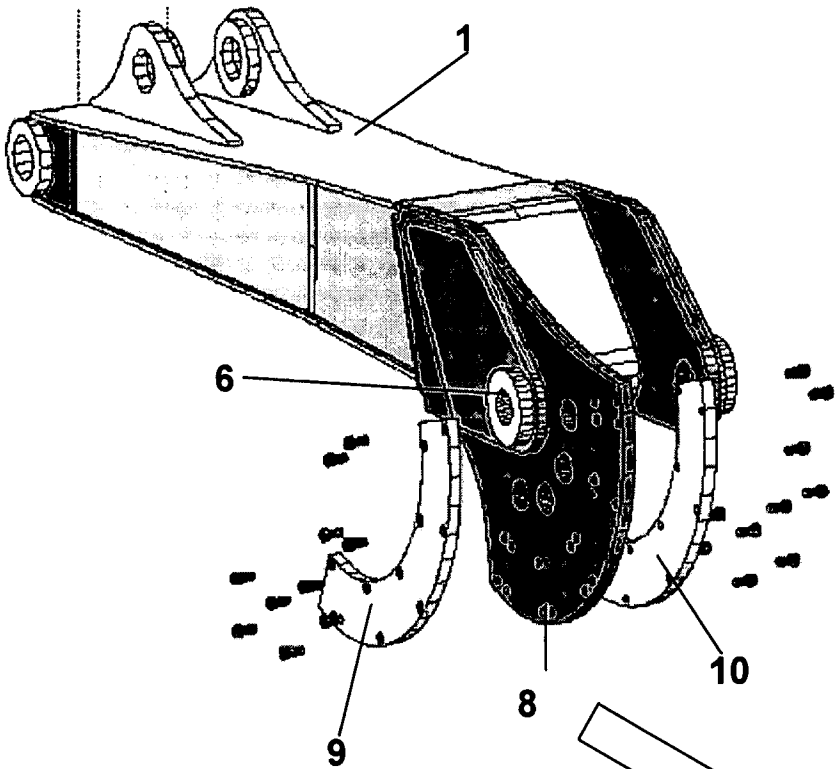
FIGS. 3 and 4 show an exemplary embodiment of a part of the braking device comprising a brake disk in exploded and enlarged views of the components, respectively.
Figure 4:
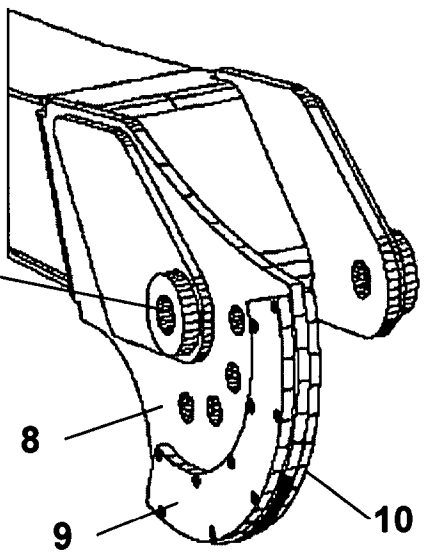

In a possible embodiment, as also shown in FIGS. 3 and 4, the braking system consists of a disk brake, comprising a rigid support 8 to which two brake disks 9 and 10 are fixed, for example with screws, at the two side surfaces. The rigid support 8 is shaped as a rigid forked extension part of the first boom 1 relative to the pivot 6.

Figure 5:
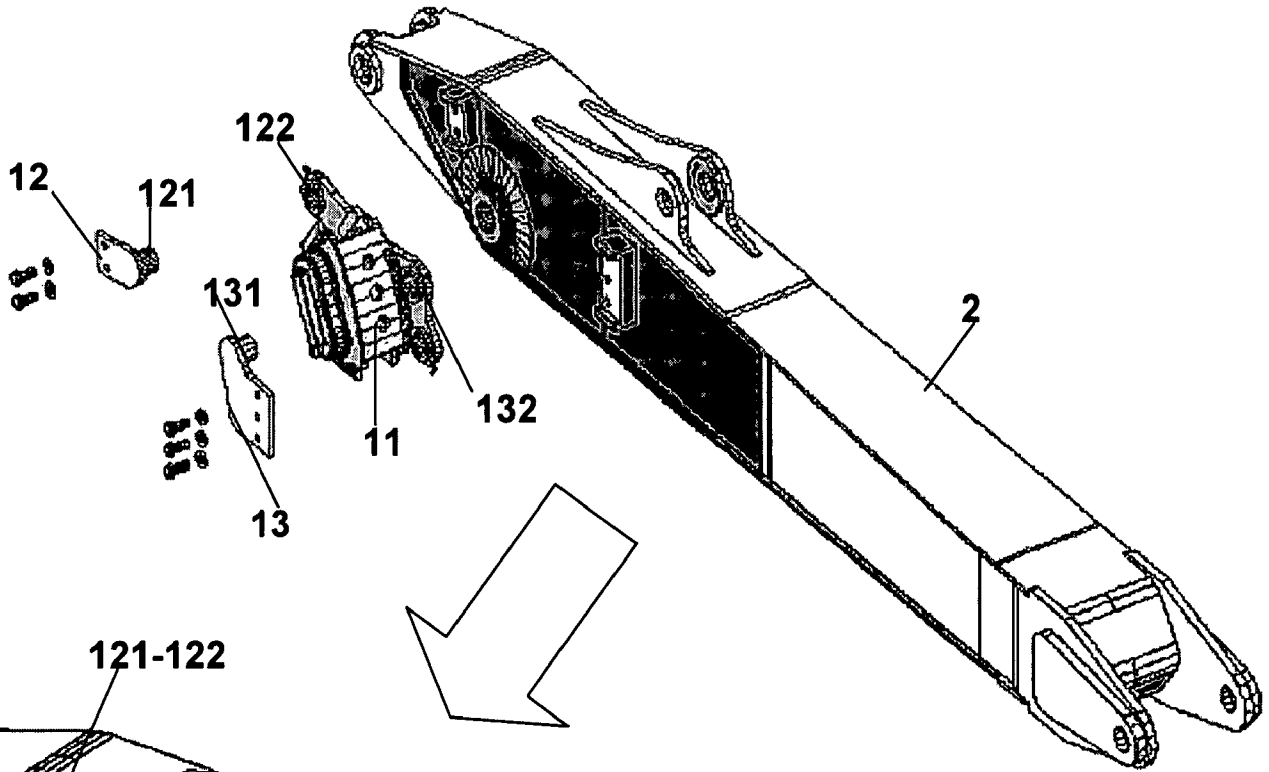
FIGS. 5 and 6 show an exemplary embodiment of a part of the braking device comprising a brake caliper in exploded and enlarged views of the components, respectively.
Figure 6:
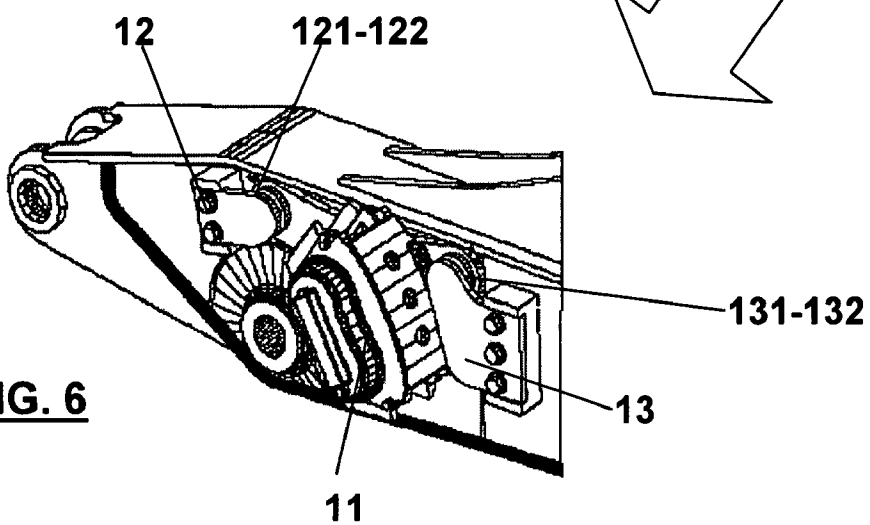

FIGS. 5 and 6 show another component of the braking system, which consists of a brake caliper 11 which is wound around the brake disks (as shown in FIG. 2). The brake caliper 11 is fixed to the second boom 2 with two supports, 12 and 13, in order to keep it in a fixed, longitudinal position relative to the second boom—but floating crosswise relative to the second boom—around the disks. As a matter of fact, the two supports 12 and 13 comprise pivots 121 and 131, respectively, fitted into their holes, 122 and 132, drilled at the ends of the caliper 11, which allow the caliper to slide sideways. By doing so, the side clearances of the caliper—generated under the braking action—will be taken up with respect to the brake disk, thereby preventing the caliper from producing side thrusts on the disk. There may be several holes (122 or 132) on the same side in order to adjust the crosswise position of the caliper relative to the second boom.

The rigid extension 8 of the disk brake is achieved with an angle which makes it possible to work with the caliper 11 (fixed to the second boom) at all possible angles between the two booms.

Figure 7:
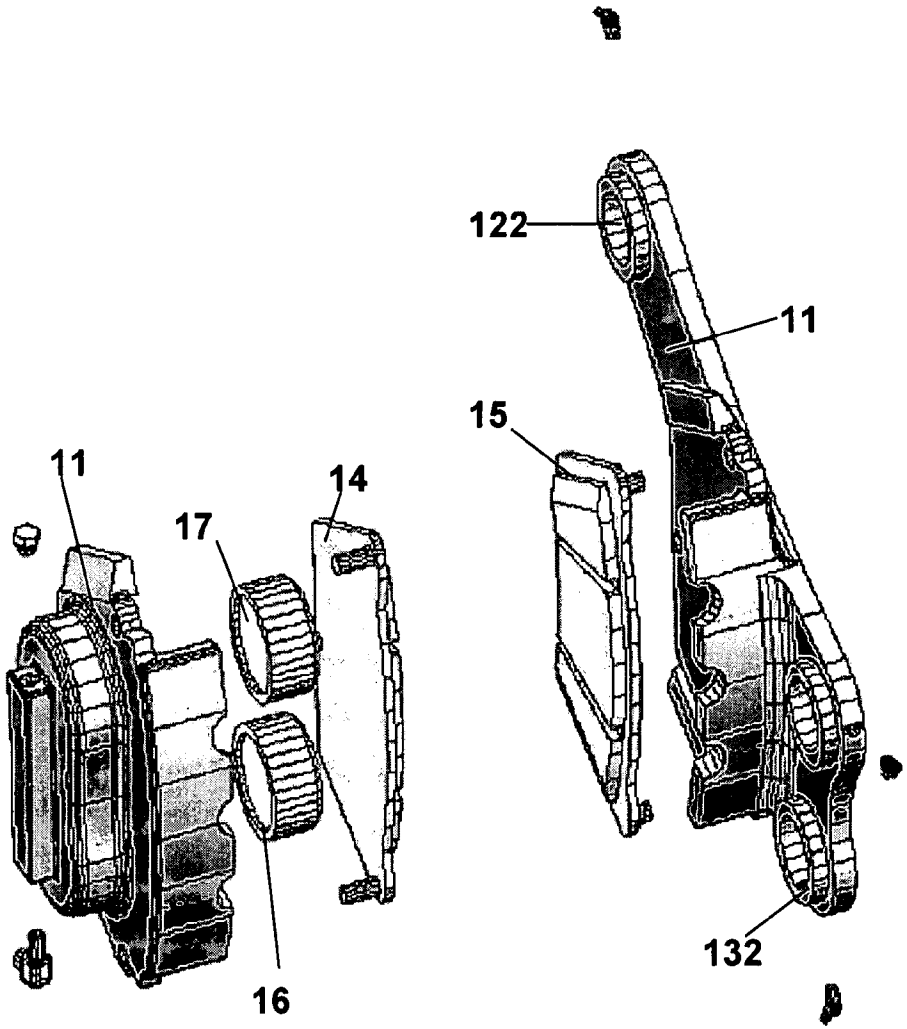
FIG. 7 shows an exemplary embodiment of the brake caliper in exploded view of the components.

FIG. 7 shows an exploded view of the caliper 11, showing its possible embodiment, in which there are two pads 14 and 15 inside the caliper, capable of pressing against the brake disks 9 and 10 (FIG. 2), via the force exerted by two pistons 16 and 17 inserted in one side of the caliper—in a suitable recess—and controlled by the brake fluid circuit. The caliper casing is actually in one piece, shown in two parts in exploded view in order to show its internal components.

Figure 8:
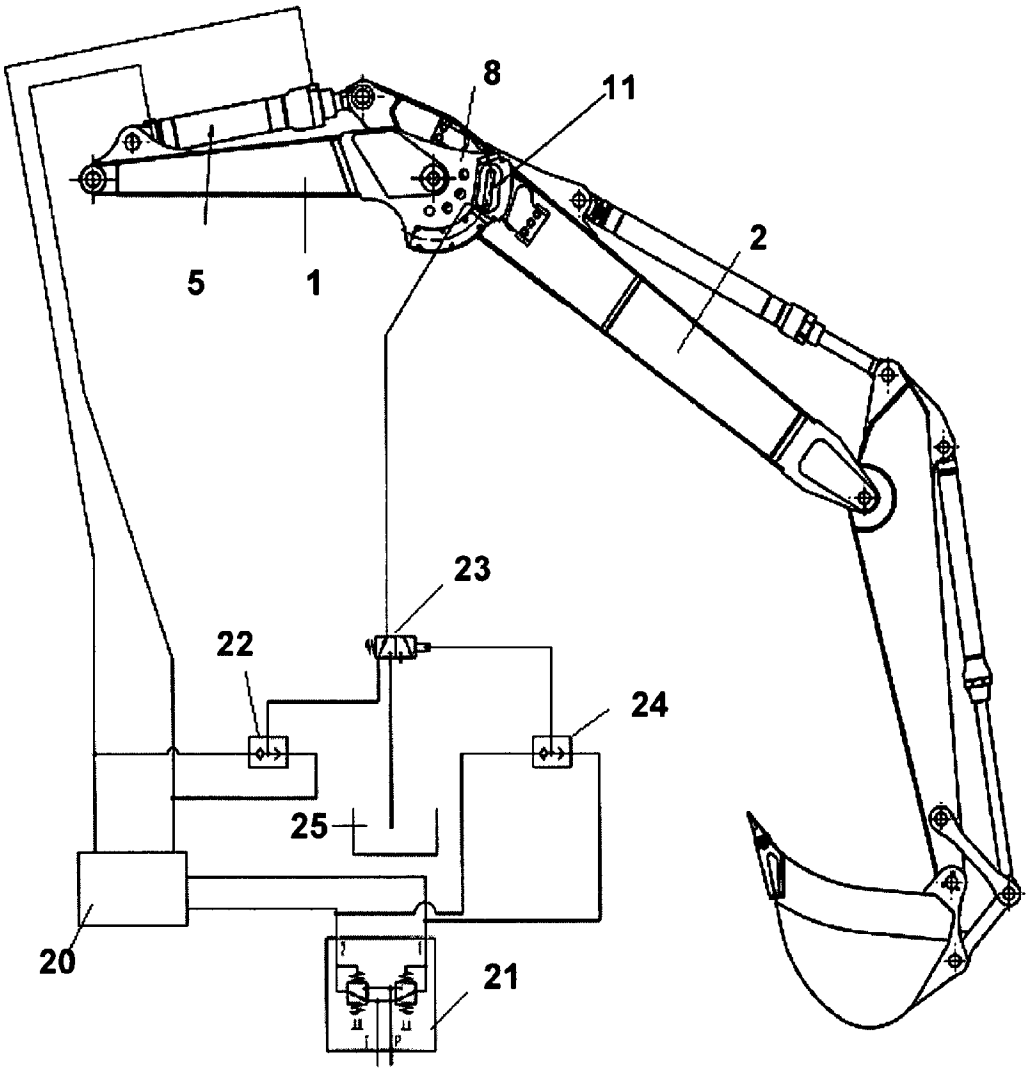
FIG. 8 shows an exemplary embodiment of a hydraulic circuit capable of controlling the operation of the braking system.

With reference to FIG. 8, as far as the fluid circuit control is concerned, a check valve 20 is used for supplying, in a way in itself known, the ends of the positioning cylinder 5—which are provided with inlet points for the fluid inside the cylinder—with hydraulic pressure via two fluid lines, in order to adjust the cylinder elongation according to the command given by the operator via a pilot valve 21. By doing so, induced pressures are generated in the fluid circuits of the cylinder and are used for operating the braking system. The pressurized fluid of the two lines is also directed in parallel to a bistable shuttle sector valve 22 which transfers the inlet fluid pressure having the highest value between the two lines, to the outlet. The valve outlet 22 is directed to the inlet of a brake release valve 23 which sends the pressurized fluid to the pistons of the brake caliper 11. Therefore, the induced pressure on the positioning cylinder 5 is shared with the braking system 7. The braking pressure—which, for that matter, is equal to the induced pressure in the positioning cylinder—is proportional to the load on the cylinder and can reach extremely high values, even up to 800 bars or more.

In order to operate the positioning cylinder so that the elongation can be changed, thus changing the angle between the two supporting booms 1 and 2, the release valve 23 is operated by activating the check valve 20, directed to a control inlet of the release valve 23 via a second sector valve 24, which opens the release valve and releases its fluid overpressure into a fluid containment tank TNK. By doing so, the braking system opens up, thereby operating the positioning cylinder, in order to change the angle between the two booms 1 and 2.

Therefore, the braking method related to this invention involves:

using the induced pressure in the positioning cylinder to operate a braking system set between the two supporting booms;

keeping the braking system braked during the time in which the positioning cylinder is kept inactive in a fixed position;

opening the braking system when the elongation of the positioning cylinder must be changed.

Since the braking system pads press against the disks without sliding, thereby minimizing their wear, it is advantageously possible to have them both (pads and disks) made of steel (inexpensive and capable of withstanding high pressures) so that it will not be necessary to replace them throughout the whole lifetime of the machine.

All hydraulic circuit valves may be of any known type, as long as their dimensions are suitable for their intended purpose, according to the power of the machine.

It will be apparent to the person skilled in the art that other alternative and equivalent embodiments of the invention can be conceived and reduced to practice without departing from the true spirit of the invention. In the case of an excavator equipped with extra supporting booms, wherein there are more than two supporting booms, a braking system may be required for each positioning joint.

The positions of the disks and calipers may be reversed on different booms: brake disk on the first boom and caliper on the second boom, as described in the previous example, or brake disk on the second boom and caliper on the first boom. Brake disks may be provided on both sides of one or more supporting booms. Different conformations of the rigid extension part 8 as well as different positioning points on the supporting boom are possible.

There may also be machines equipped with more than one cylinder, typically two on the two sides of the first boom, at the front or rear side relative to the elongation of the excavator booms. However, any angular position of the extension which carries the brake disk relative to the pivot between the two supporting booms is possible, depending on the position of the brake caliper and of the positioning cylinder (or cylinders), thereby preventing them from interfering with each other.

It is possible to use drum brakes instead of disk brakes, with per se known installation methods.

The advantages in connection with the use of this invention are clear. The braking system subject of this invention reduces the load on the positioning cylinder by a typical value of 30%, hence increasing the operating capacity of the machine when in specific heavy-duty excavation conditions.

The hydraulic capacity limitations during the lifting phase occurs for higher reaction force values, with an increase in the lifting capacity.

The braking system can also be installed after purchasing the machine, hence supplied as an additional option.

Given the same total reaction force required by the machine, the installation of the braking system provides for the possibility to reduce the dimensions, hence the cost of the positioning cylinder.

The braking system reduces the risk of damaging the supports of the positioning cylinder, thus reducing the reaction force on it.

From the description set forth above it will be possible for the person skilled in the art to embody the scope of the invention without introducing any further construction details.

What is claimed is:

1. A device for braking the supporting booms of an earth-moving machine, said machine equipped with two or more supporting booms, interconnected by pivoting points, and one or more positioning cylinders capable of determining the relative angular position of said supporting booms, comprising:

one or more braking systems applied to said supporting booms, capable of exerting a braking action on said supporting booms, thus reducing the reaction force of the said one or more positioning cylinders;

said one or more braking systems comprise first devices to determine a braking torque relative to said pivoting points, said first devices comprise one or more disk brakes to determine a braking torque on said pivoting points;

said one or more disk brakes comprising a rigid support shaped according to a rigid, forked extension part of a first supporting boom, relative to a connecting pivoting point with a second supporting boom, said rigid support being applied to one or more brake disks; and at least one brake caliper wound around the said one or more brake disks, applied to the said second supporting boom; and second devices for keeping said brake caliper in a fixed position relative to said second supporting boom and to allow a flotation of said brake caliper around said brake disks and integral with said second boom and comprise pivots fitted into their holes, drilled at the ends of said caliper, which allow the caliper to slide sideways.

2. A device according to claim 1, wherein said at least one brake caliper comprises pads capable of pressing against said brake disks, and one or more pistons applying pressure to said pads.

3. A device according to claim 2, wherein said pads are made of steel.

4. A device according to claim 1, further comprising third devices for operating said one or more braking systems by using an induced pressure generated in the hydraulic circuits of the said one or more positioning cylinders.

5. A device according to claim 4, wherein said third devices comprise valves capable of providing the said one or more braking systems with said induced pressure during the time in which the said one or more positioning cylinders remain inactive and to remove said induced pressure when the elongation of the said one or more positioning cylinders must be changed in order to change a relative angular position between said supporting booms.

6. An earthmoving machine comprising a device for braking supporting booms as described in claim 1.

7. A device for braking the supporting booms of an earthmoving machine, said machine equipped with two or more supporting booms, interconnected by pivoting points, and one or more positioning cylinders capable of determining the relative angular position of said supporting booms, comprising:

one or more braking systems applied to said supporting booms, capable of exerting a braking action on said supporting booms, thus reducing the reaction force of the said one or more positioning cylinders;

said one or more braking systems comprise first devices to determine a braking torque relative to said pivoting points;

third devices for operating said one or more braking systems by using an induced pressure generated in the hydraulic circuits of the said one or more positioning cylinders, third devices having valves capable of providing the said one or more braking systems with said induced pressure during the time in which the said one or more positioning cylinders remain inactive and to remove said induced pressure when the elongation of the said one or more positioning cylinders must be changed in order to change a relative angular position between said supporting booms;

said valves comprising a check valve for supplying the two ends of the said one or more positioning cylinders with hydraulic pressure, according to the command given via a pilot valve, in order to generate induced pressures within the fluid circuits of the said one or more positioning cylinders;

a first bistable shuttle sector valve which receives from said check valve said hydraulic pressure at the two ends of the said one or more positioning cylinders, and delivers the hydraulic pressure having the highest value to the outlet; and a first brake release valve which receives the outlet of said first sector valve and delivers said hydraulic pressure having the highest value to the said one or more braking systems.

8. A device according to claim 7, wherein said valves also comprise a second sector valve controlled by said pilot valve, the outlet of which is directed to an actuating inlet of said brake release valve in order to determine the opening of said brake release valve as well as the release of said hydraulic pressure having the highest value when the elongation of the said one or more positioning cylinders must be changed.

9. A device according to claim 7, wherein said first devices comprise one or more drum brakes to determine a braking torque on said pivoting points.

10. A method for braking the supporting booms of an earthmoving machine, said machine equipped with two or more supporting booms, interconnected by pivoting points, and one or more positioning cylinders capable of setting the relative angular position of said supporting booms the machine having at least one braking system associated with a connection between said supporting booms and operable to brake pivotal movement of one boom relative to the other boom, thereby reducing the reaction force generated by the booms onto the one or more positioning cylinders, comprising the steps of:

directing an induced pressure present in the hydraulic circuits of the said one or more positioning cylinders to the braking system in order to apply a braking force to the said two or more supporting booms;

keeping the said one or more braking systems braked during the time in which the said one or more positioning cylinders are kept inactive in a fixed position; and opening the braking system when the elongation of the said one or more positioning cylinders must be changed in order to direct fluid to the one or more positioning cylinders to change the relative angular position between the said two or more supporting booms.

* * * * *